US005593648A

United States Patent [19]

Christie et al.

[11] Patent Number: 5,593,648

[45] Date of Patent: Jan. 14, 1997

[54] CHILD-RESISTANT DISPENSING DEVICE FOR AUTOMATIC WASHING MACHINES

[75] Inventors: Julie A. Christie, Newcastle upon Tyne; Brian E. Talkes, Northumberland, both of England

[73] Assignee: The Procter & Gamble Company, Cincinnati, Ohio

[21] Appl. No.: 496,703

[22] Filed: Jun. 29, 1995

[30] Foreign Application Priority Data

Jul. 9, 1994 [GB] United Kingdom ..... 9413874

[51] Int. Cl.[6] ..... B01F 1/00

[52] U.S. Cl. ..... 422/266; 422/277; 134/93; 4/227.1; 4/231

[58] Field of Search ..... 422/263, 266, 422/276, 277; 4/227.1, 231; 134/93; 68/17 R; D23/3

[56] References Cited

U.S. PATENT DOCUMENTS

| | | | |
|---|---|---|---|
| D. 254,187 | 2/1980 | Freese | D32/3 |
| 2,880,077 | 3/1959 | Floria | 422/277 |
| 4,168,551 | 9/1979 | Hautmann et al. | 4/231 |
| 4,261,957 | 4/1981 | Schimanski | 422/277 |
| 4,569,781 | 2/1986 | Fernholz et al. | 252/92 |
| 4,777,670 | 10/1988 | Klinkhammer et al. | 422/263 |
| 4,808,236 | 2/1989 | Davis, Jr. | 134/25.2 |
| 4,948,002 | 8/1990 | Thornock et al. | 215/221 |
| 5,186,912 | 2/1993 | Steindorf et al. | 422/263 |

*Primary Examiner*—Robert J. Warden
*Assistant Examiner*—Theresa T. Snider
*Attorney, Agent, or Firm*—Michael D. Jones; Jerry J. Yetter; Jacobus C. Rasser

[57] ABSTRACT

A dispensing device for tablet detergent compositions for use in automatic washing machines. The dispensing device has an opening for the insertion of the tablet into the body of the dispensing device, wherein adjacent to the opening there is a restraint for substantially restricting the removal of the tablet after it has been inserted into the dispensing device.

18 Claims, 5 Drawing Sheets

FIG. 5
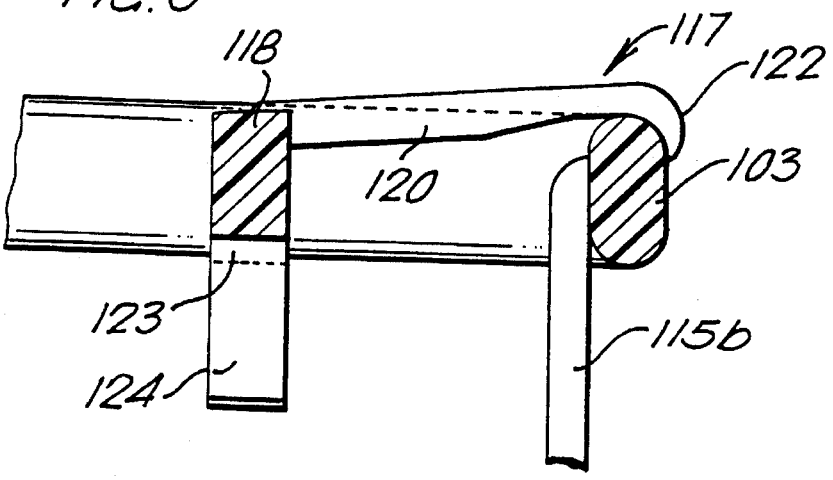
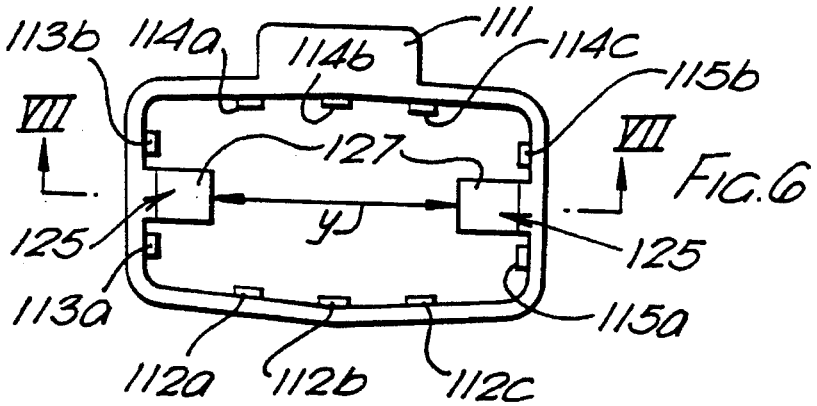
FIG. 6
FIG. 7
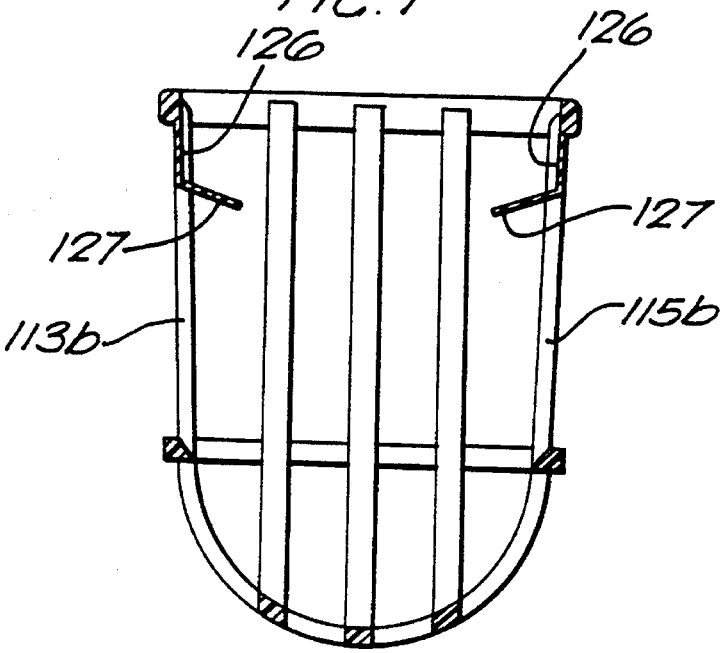

CHILD-RESISTANT DISPENSING DEVICE FOR AUTOMATIC WASHING MACHINES

TECHNICAL FIELD OF THE INVENTION

The present invention relates to tabletted detergent composition dispensing devices for use in automatic dish and laundry washing machines. The dispensing devices are provided with a child resistant restraint means to prevent the removal of the tabletted detergent composition from the dispensing device prior to the dissolution of the tablet in the wash liquor.

BACKGROUND OF THE INVENTION

The traditional form of detergent compositions for use in automatic dish or laundry machines is granular or particulate, which are placed in the dispenser located in the door of a dishwashing machine or in the dispensing tray of an automatic laundry washing machine.

However, in order to simplify the dosing of detergents for automatic washing machines, many detergent compositions are provided not only in particulate form but also in the form of non particulate solids such as bars briquettes or more commonly tablets. This provides a number of advantages to both the consumer and manufacturer. Firstly, such tablets eliminate the need for the consumer to estimate the dosage of detergent composition required and ensure that the correct dosage of detergent composition per wash is used by the consumer. Secondly, tablets eliminate the problem of spillage of a powdered detergent composition. Thirdly, the use of tablets minimises the contact by the consumer with the composition.

To further simplify dosing and in order to maximise performance of the tabletted detergent compositions, many of the detergent composition manufacturers provide the consumer with separate dispensing devices in which to place the tabletted detergent composition. Dispensing devices in the form of baskets or cradles to maximise the performance of tablets in automatic dishwashing machines are therefore well known in the art.

U.S. Pat. No. 5,186,912/WO 92/11797 discloses a dispenser for solid dishwashing detergent compositions for dishwashing machines. This dispenser is placed within the washing chamber of the machine and comprises a container with a lid. The container has plurality of openings to allow water to enter and a slot on a side wall to allow drainage of the detergent composition solution.

U.S. Pat. No. 4,569,781 discloses a disposable container for automatic dishwashing compositions containing a solid cast detergent composition. The container and solid cast detergent are specifically designed for use in dishwashing machines having a dispensing device designed to dispense liquid detergents formed from solid casts using a liquid spray.

U.S. Pat. No. 4,808,236 discloses a dispenser for a solid detergent composition for use in an automatic dishwashing machine. The dispenser is a container having an opening in the container top, side walls and an open bottom mouth having a removable lid. The dispenser is placed upright in the dishwashing machine.

However, the use of such dispensing devices can still enable access to the detergent composition by young children and infants, especially if the detergent is placed in the dishwashing machine without starting the wash program of the machine. The risk also exists of the removal of the tablet from the dispensing device by the child and the subsequent accidental ingestion of the tablet as the latter represents a product form which children can easily place in the mouth.

Therefore, it is an object of the present invention to provide a dispensing device for tabletted automatic washing machine detergent compositions, such that the tablet cannot be easily removed from the dispensing device by young children or infants, once inserted.

It has now been found that these objectives can be achieved by a dispensing device having an opening for the insertion of the tablet, which has a child resistant restraint means.

Child resistant closing devices for packages are well known in the art. For example U.S. Pat. No. 4,948,002 discloses a package with a child resistant opening which is readily openable by adults, particularly by adults with impaired manual dexterity. The package comprises a bottle and closure, the bottle having a collar with a pair of spring like push tabs containing vertical extensions which engage interlocking teeth of the closure skirt. However, this form of child resistant closure is designed for packages in which the closure is intended for removal from the bottle in appropriate circumstances. Such a design is not suitable for the problem addressed by the present invention where removal of a detergent tablet, once inserted into the container, is not desired.

SUMMARY OF THE INVENTION

According to the present invention there is provided a liquid-permeable dispensing device adapted to retain a tabletted automatic washing machine detergent composition prior to dissolution in the wash liquor, said device comprising a hollow body having an opening to allow the introduction of said tabletted detergent composition into said device, wherein said body is provided with a restraint means adapted to prevent the removal of said tabletted detergent composition through said opening, and wherein said restraint means is a child resistant-restraint.

As used herein, the term child resistant restraint means refers to any mechanism whereby access to the tablet, once inserted into the dispenser, is restricted so that the tablet cannot be readily removed by infants and children. Preferably, the child resistant dispensing device of the present invention is adapted so that the insertion of the tablet into the dispensing device may be easily achieved by adults, particularly adults having impaired dexterity of their hands and/or fingers.

In a highly preferred embodiment of the invention the portion of the body of the dispensing device defining the opening is self supporting, thereby permanently maintaining the opening in a predetermined configuration. The opening may be in the base, side wall or top portion of the dispensing devices, but preferably the opening is in the top portion.

The opening must be larger than the maximum cross sectional dimension of a tablet in the orientation in which it is inserted into the dispensing device. Preferably, the tablet is inserted into the device with its side edges facing the opening. Acordingly, the opening is sized to be larger than the maximum cross sectional dimension of the tablet when viewed from the side and is preferably configured to correspond generally to the profile of the tablet in side cross sectional view.

According to the present invention the restraint means is secured to the portion of the body defining said opening. The restraint means may be secured at a fixed distance from said opening, provided that the tablet is retained in the body portion of the dispensing device behind said restraint means. The restraint means comprises one or more elements which are resiliently deformable or resiliently hingeable to permit displacement from their rest position in the direction of insertion of a tablet into the dispensing device. Once the tablet is positioned within the hollow body of the dispensing device, the elements return to their rest position, in which position the elements may entirely close or partially close the opening of the dispensing device. Said elements have minimal and preferably no, deformation capability, or hingeable motion about their rest positions, in the direction opposite to the direction of displacement, so that the tablet-ted detergent composition once inserted into the body, cannot readily be removed therefrom.

The restraint means can be secured to the body portion in a variety of ways subject only to the requirement that the securement should not be capable of easy detachment by a child. Thus the securement can be permanent or can be releasable. Permanent securement can include the restraint means being unitary with the body portion as well as via adhesive or thermal bonding, ultrasonic or thermal spot welding and physical attachment by staples, rivets etc. where appropriate.

Temporary attachment can include snap fitting of one or more elements of the restraint means to the body portion or the encirclement of a segment of the body portion by an element of the restraint means to provide a loose hinge.

In a preferred embodiment of the present invention the body has a cage, mesh or perforated sheet structure, so that the device has multiple orifices and is thereby liquid permeable. The orifices allow water to enter the dispensing device and aid the uniform dissolution of the tablet during the wash cycle of the automatic washing machine. The orifices are preferably evenly distributed throughout the body of the device and are dimensioned such that an issued tablet cannot be removed from the dispensing device there through.

In a highly preferred embodiment of the present invention the device has a cage structure in which the body comprises a rigid framework having base, side wall and top portions, the side wall portion being secured to the base portion and extending around the periphery thereof. Preferably the side wall portion extends substantially perpendicularly from the base portion.

The dispensing device of the present invention may find utility in all types of automatic dish- or laundry washing machines including domestic and industrial machines.

BRIEF DESCRIPTION OF THE DRAWINGS

The invention is illustrated in the accompanying drawings in which:

FIG. 5 is a partial cross-sectional side view of the top of the device taken on the line V—V of FIG. 4

FIG. 6 is a simplified top plan view of a second embodiment of the dispensing device of the present invention.

FIG. 7 is a side view in section of the device of FIG. 6 viewed along the line VII—VII

DETAILED DESCRIPTION OF THE INVENTION

Referring to FIGS. 1–5 of the drawings, a first preferred embodiment of the dispensing device of the present invention comprises a liquid-permeable container 100 having a cage-like structure and formed of moulded rigid synthetic plastics material. The container 100 comprises a base portion generally indicated at 101, a body portion generally indicated at 102 and-a top rim portion generally indicated at 103 that defines the upper extremity of the body portion and serves to define an opening 104 at the top of the container 100. Restraint means, shown generally at 105, 106, on opposite sides of opening 104 at top rim portion 103, allow entry into the container 100 of a detergent tablet but prevent its removal through the opening.

Container 100 is provided with clip means, generally indicated at 111, adapted to secure the container to a portion of the internal structure of a dishwashing machine (not shown), thereby to maintain the container 100 in an upright position.

Figure 2:
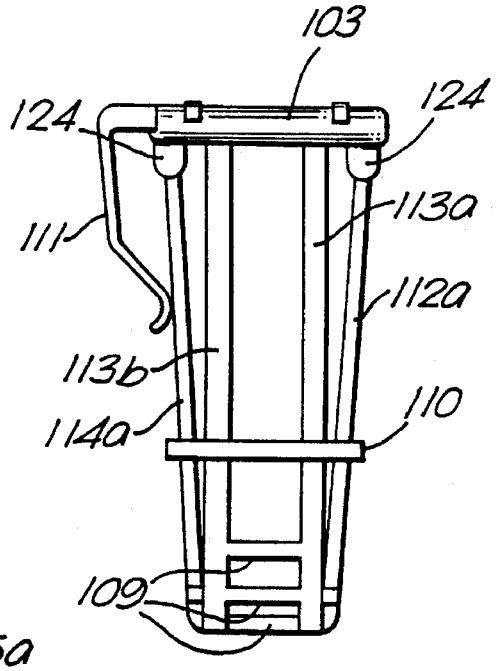
FIG. 2 is a side view of the dispensing device of FIG. 1.
Figure 3:
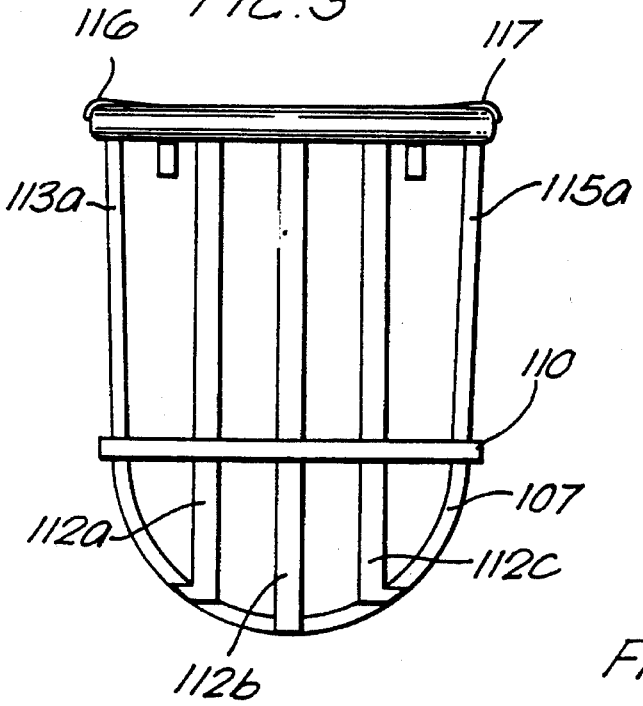
FIG. 3 is a front view of the dispensing device of FIG. 1.
Figure 4:
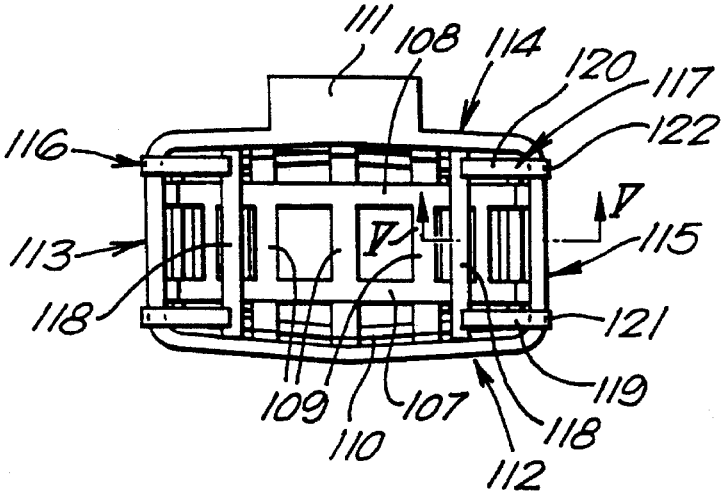
FIG. 4 is a top view of the dispensing device of FIG. 1.

Opening 104 of container 100 is of generally rectangular configuration in plan and body portion 102 is formed with four walls shown generally in FIG. 4 at 112, 113, 114 & 115, the side walls converging towards the base portion 101 as shown more clearly in FIGS. 2 & 3.

Opposed side walls 112 & 114 are respectively formed of three spaced members 112*a*, 112*b*, 112*c*, 114*a*, 114*b*, 114*c*, of generally rectangular cross section, that extend from top rim portion 103 to base portion 101. The lower ends of side walls 112 & 114 have a convex curvature of generally semicircular configuration. Opposed side walls 113 & 115 are respectively formed of two spaced members 113*a*, 113*b*, 115*a*, 115*b* of generally rectangular cross section that extend from top rim portion 103 to base portion 101. Base portion 101 is provided with two convexly curved members 107 & 108 of generally semicircular configuration that connect the lower ends of members 113*a* & 115*a* and 113*b* & 115*b* respectively and also terminate the lower ends of members 112*a, b* & *c* and 114*a, b* & *c* respectively. Convexly curved members 107 and 108 are, in turn, connected to each other by means of a series of parallel spaced cross members 109. Base portion 101 also comprises a base circumferential member 110 that extends around the periphery of side walls 112, 113, 114, 115 at the level of juncture of the members 113*a*, 113*b*, 115*a* & 115*b* with their respective curved members 107 & 108.

Restraint means 105, 106 comprise a pair of restraining elements 116, 117 hingedly mounted at the upper extremities of side walls 113, 115, on top rim portion 103. Both elements are of identical construction but for the purpose of simplicity, only restraining element 117 will be described.

Restraining element 117 comprises a bar element 118 hingedly attached to top rim portion 103 through two hinge arms 119, 120 that reduce in cross section to form claws 121, 122 that are bonded to the top rim portion. Limited rotational movement of the restraining element 117 thereby occurs preferentially at the points of reduced cross sectional area of hinge arms 119, 120 adjacent the junctions of claws 121, 122 with top rim portion 103. Hinge arms 119, 120 are disposed respectively laterally outwardly of the junctions of members 113*a* & 113*b* with top rim portion 103. Bar dement 118 is disposed parallel to top rim portion 103 and has a lateral extent less than the width of side wall 113 at top rim portion 103. Each lateral extremity of bar element 118 is formed with a J-shaped projection 123, disposed perpendicularly to bar element 118, that extends into the interior of the container 100.

The free ends of the J-shaped projections 123 (shown as 124 in FIGS. 1, 2 & 5) extend outwardly in a direction parallel to bar member 118 so as to underlie top rim portion 103 on each of side walls 112 & 114, as shown in FIG. 2. Thus, restraining dement 117 is free to rotate through an are of approximately 90°, from a lower position in which bar element 118 bears against the member 115*a*, 115*b* to an upper position in which free ends 124 of J-shaped projections 123 bear against the undersides of opposed edges of top rim portion 103.

The lower position constitutes the disposition of the restraint means during loading of the container with one or more detergent tablets, while the upper position represents the disposition taken up by the restraint means if removal of the tablet(s) through opening 104 is attempted e.g. by a child. FIG. 5 shows the restraint means disposed close to its upper position.

Alternative forms of restraint means suitable for the dispensing device of FIG. 1–4 are illustrated in FIGS. 6–10.

FIGS. 6 & 7 illustrate a second preferred embodiment of the invention. FIG. 6 is a top plan view of the dispensing device in which details of the container body and the base portion have been omitted for clarity. The restraint means comprises two flexible resilient oblong leaf members 125, integral with and dependent from top rim portion 103 at side walls 113, 115 respectively. The members 125 are disposed centrally with respect to their side walls. As best seen in FIG. 7, each leaf member 125 is formed with an upper portion 126, which is disposed so as to be coplanar with the inner surface of the respective side wall member, and a lower portion 127 which is deflected approximately 60° out of the plane of the side wall into the interior of the container. Portions 126 & 127 are of approximately equal size and the distance 'y' (FIG. 6) between the lowermost edges of portions 127 is predetermined to be less than the corresponding dimension of a detergent tablet. Members 125 are formed to have a flexibility and resilience such that they will deflect to allow insertion of a tablet into the container but will thereafter return to their original positions, thereby to resist removal of the tablet through the opening 104.

Figure 8:
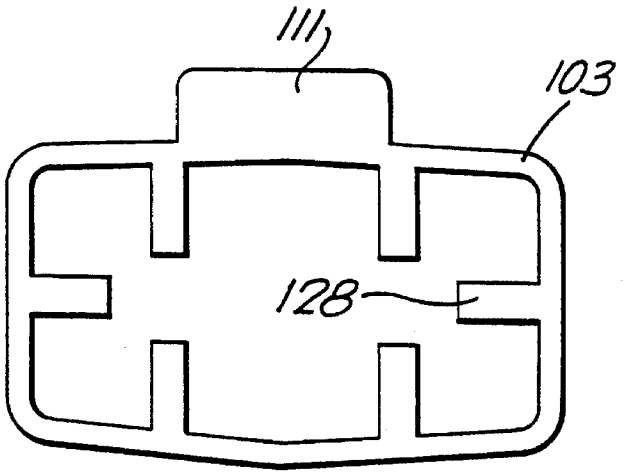
FIG. 8 is a top view of an alternative form of restraint means for the dispensing device of FIG. 1

FIG. 8 is a top plan view in similar simplified form to FIG. 6, and shows the restraint means as a series of short flexible resilient numbers 128 integral with and disposed around top rim portion 103. Members 128 have a cross sectional form that permits their initial deflection to allow insertion of a tablet into the container and their subsequent recovery to their original position to prevent removal of the tablet. Each member 128 can either be coplanar with the top surface of top rim portion 103 or can have a form and disposition similar to that of members 125 of FIG. 6.

Figure 9:
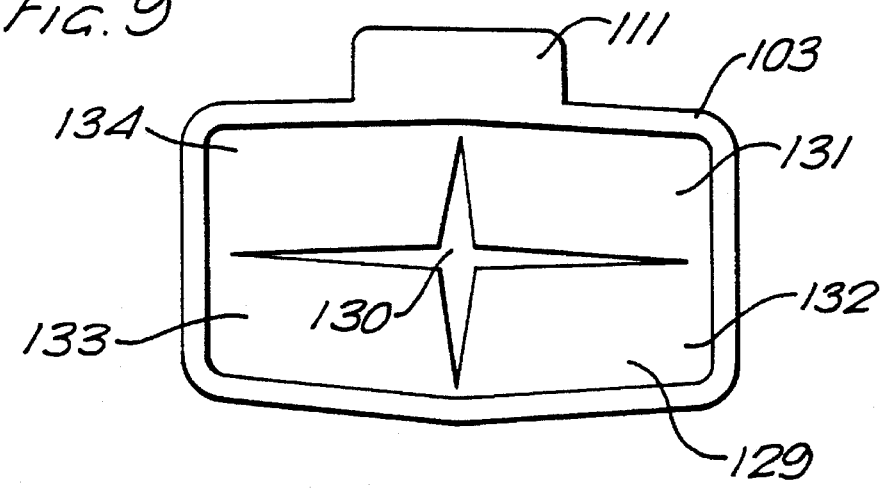
FIG. 9 is a top view of a further alternative form of restraint means for the dispensing device of FIG. 1

FIG. 9 is a further alternative embodiment in which the restraint means comprises a thin resilient film or leaf 129 that forms a cover to the container 100 contiguous, and preferably integral, with top rim portion 103, the film or leaf being provided with a cruciform opening 130. The opening separates the film into four quadrants 131, 132, 133, 134, each of which can deflect to allow a tablet to be pushed into a container, each quadrant subsequently returning to its original position.

Figure 10:
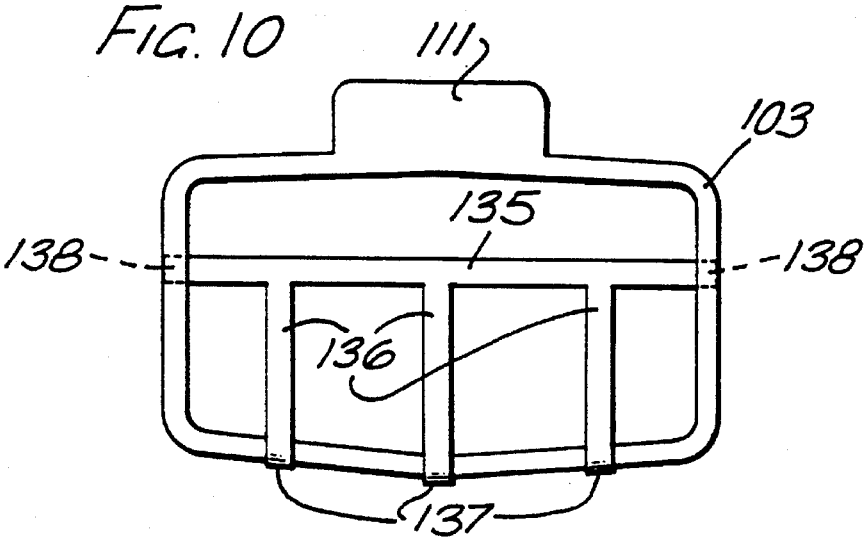
FIG. 10 is a top view of a still further alternative form of restraint means for the dispensing device of FIG. 1

A yet further form of restraint means is shown schematically in FIG. 10, in which a bar member 135 is disposed generally parallel to side walls 112, 114 and is secured via hinge arms 136 and claws 137 to top rim portion 103 along side wall 112. Bar member 135 engages side wall members 112*a* & 112*c* in its open (lower) position and is provided with extensions or projections 138 (shown in dotted line) that respectively engage the underside of top rim portion 103 at the side walls 113, 115 when the restraint means is in the (upper) position shown in the Figure. Hinge arms 136 are of such a length that bar member 135 is located closer to side wall 114 than to side wall 112, so that the restraint means occupies more than half of the area of the opening 104 when the restraint means is in its upper position.

Figure 1:
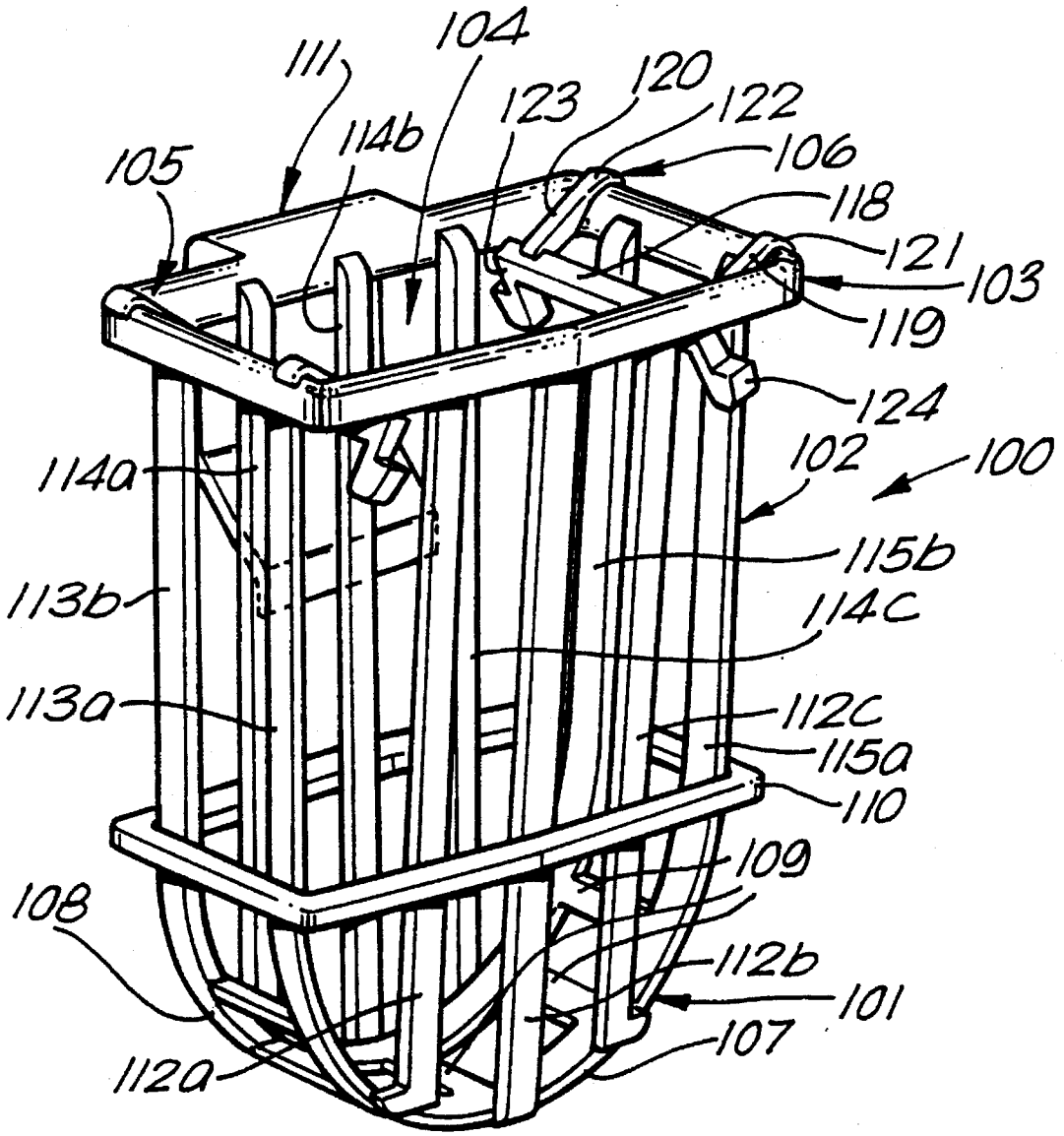
FIG. 1 is a front perspective view of a first embodiment of the dispensing device of the present invention.
Figure 12:
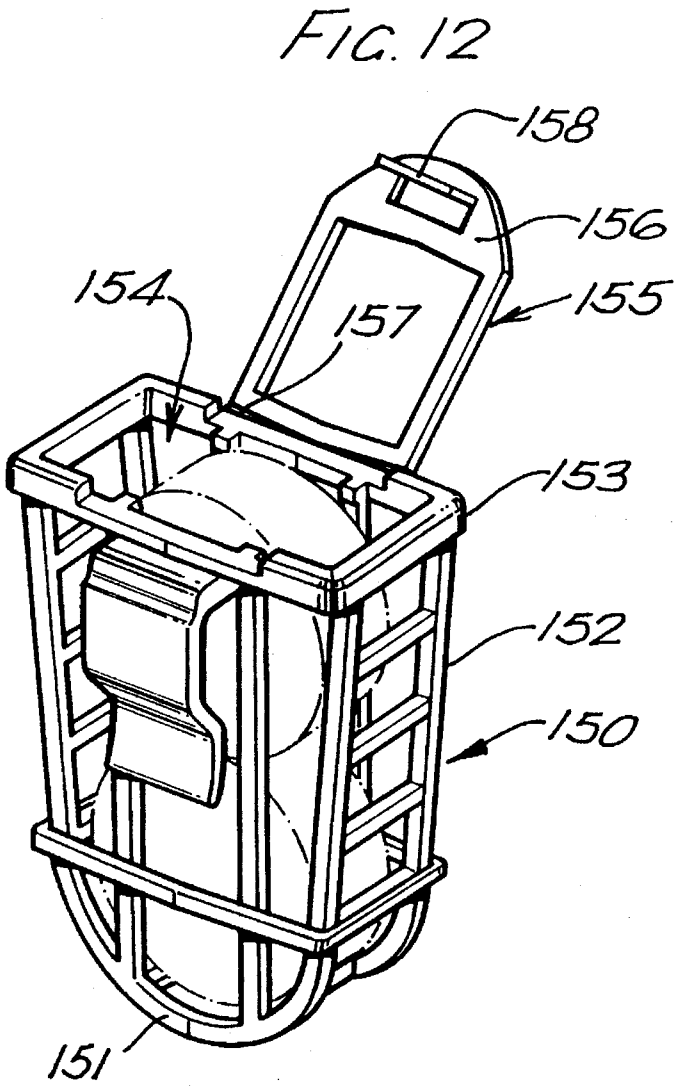
FIG. 12 is a back perspective view of a dispensing device of a fourth embodiment of the present invention.
Figure 11:
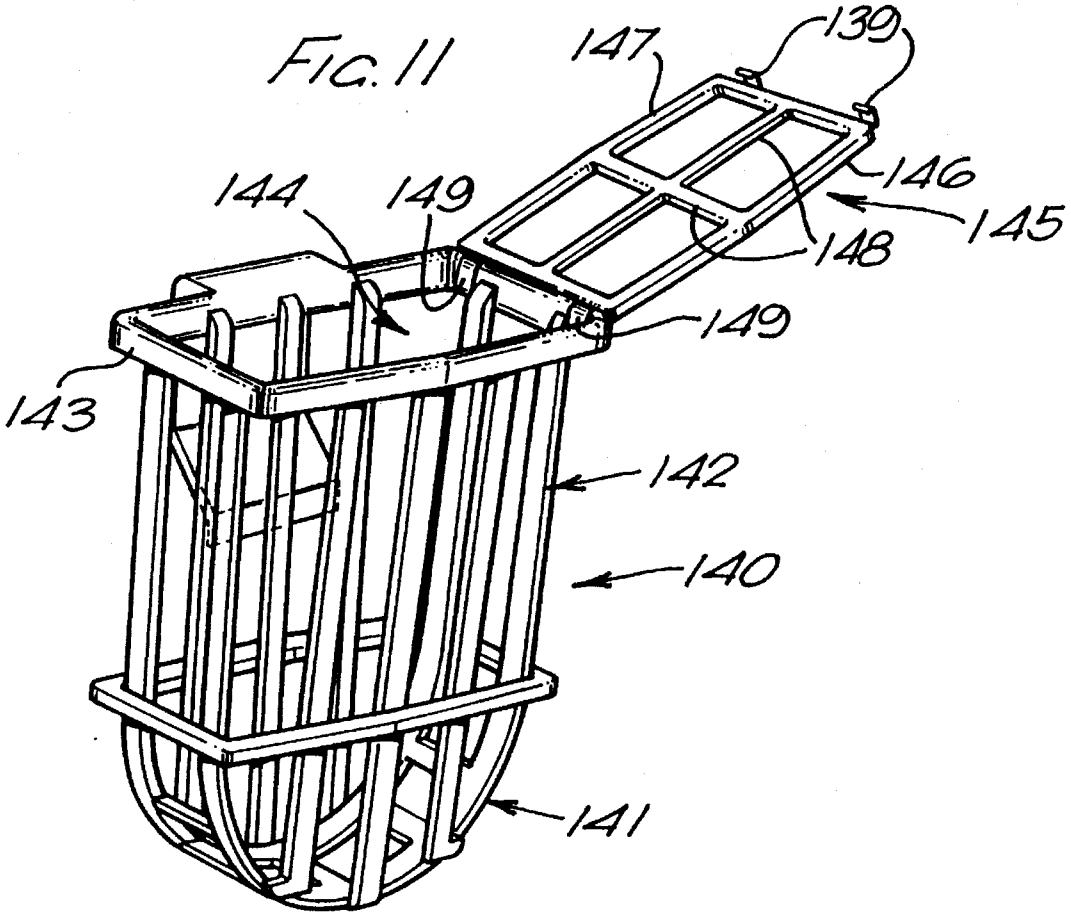
FIG. 11 is a front perspective view of a dispensing device of a third embodiment of the present invention.

FIG. 11 illustrates a further embodiment of the invention in which a container shown generally at 140 has a cage-like form similar to the embodiment of FIG. 1 with a base portion 141, a body portion 142 and a top rim portion 143 that defines a generally rectangular opening 144. Restraint means, shown generally at 145, comprises a generally rectangular open lid structure 146 preferably formed of the same (plastics) material as the container 140 and comprising a rim portion 147 and cross members 148 connected to opposite sides of the rim. The lid is hingedly attached at 149 along one side of top rim portion 143 and is provided with claw means 139 that provide a releasable snap fit attachment over the opposite side of top rim portion 143 to that of the hinged attachment 149. A yet further embodiment is illustrated in FIG. 12 which shows a container 150 of the general form as that of FIG. 1. Container 150 is provided with base portion 151, body portion 152 and top rim portion 153 defining an opening 154. Restraint means 155 comprises an open lid structure 156 extending between the two longer sides of top rim portion 153 but not extending the full length of each longer side. Lid structure 156 is inset into top rim portion 153 and hingedly attached thereto by hinge means 157. The lid structure 156 is provided at the side edge opposite the hinge with a projection 158 adapted to extend into the container 150 when the lid is closed and engage with the container side wall to prevent easy opening of the lid structure.

Although the embodiments described hereinbefore that incorporate hinged restraint means utilise heat bonding to secure the hinge of restraint means to the top rim portion, other securement means can be used. Thus, the hinge(s) may be adhesively bonded to the top rim portion or the claws may be formed to be a snap fit on the top rim portion.

FIG. 12 shows a preferred arrangement in which two tablets are disposed within the container and the embodiments hereinfore described are shaped and dimensioned so as to contain two tablets of approximately 50g weight of cylindrical form preferably with tapered top and bottom surfaces. However, devices in accordance with the present invention may be of any shape compatible with the detergent tablets intended for use therein.

The materials of construction of the dispensing devices of the present invention may comprise any that can withstand the temperature, pH and oxidising bleach conditions encountered in domestic washing machines, particularly domestic automatic dishwashing machines. Materials such as stainless steel, anodised aluminium or plastic coated metal can be used but the preferred material is a synthetic polymeric plastics material which can be fabricated economically into a substantially rigid but open cage structure. Suitable materials include acrylic-butadiene polymers ired polyalkylene based materials, especially polyethylene or polypropylene.

In the preferred embodiments of the present invention, the dispensing device also comprises a releasable fastening means shown as 111 in the Figures of the drawings. As used herein, the term releasable fastening means refers to any means which can be adapted to secure the dispensing device to the interior of an automatic washing machine such that it can be released therefrom when required. Said fastening means is preferably made of similar or identical material to that of the dispenser itself. Preferably, the fastening means is located on the body portion of the dispenser, most preferably on the side wall portion of the dispenser. The fastening means comprises at least one clip or hook, which extends along the side wall of the dispensing device.

The dispensers of the present invention may be located anywhere within the interior of the automatic dish or laundry washing machine. The dispenser is preferably attached to the exterior of the cutlery or crockery basket or the base tray in an automatic dishwashing machine.

THE TABLETTED DETERGENT COMPOSITION

According to the present invention the dispensing devices are used to dispense a tabletted detergent composition in automatic washing machines. The term tabletted detergent composition as used herein refers to any detergent composition which is in a solid non particulate form such as a tablet, bar and briquette. Said tablet may have any shape provided that it can be placed through the opening of the dispensing device and retained within the body of the dispensing device.

Preferably, said solid non particulate composition is symmetrical to ensure the uniform dissolution of the tablet in the wash liquor.

According to the present invention the tabletted detergent composition may comprise any ingredients known in the art. Such ingredients may include surfactants, suds suppressers, bleaches, chelants, builders, enzymes, fillers and perfumes.

Preferably the detergent composition is prepared in its granular or particulate form and then formed into tablets of the desired shape and size. Tabletted detergent compositions suitable for use with the dispensing devices of the present invention can be made by any one of the methods known in the art. Suitable methods include compression, extrusion and casting. The components of the detergent composition may be homogeneously distributed throughout the tablet or certain detergent ingredients may form distinct layers.

What is claimed is:

1. A liquid permeable dispensing device for a tableted automatic washing machine detergent composition, said device comprising a liquid pemeable container having an opening for receiving a detergent tablet to be dissolved, and a liquid permeable body portion for holding a detergent tablet therewithin, and further comprising a restraint adjacent to said opening, said restraint having an original position which at least partially obstructs said opening and being attached to said container such that it can be selectively deflected to allow a detergent tablet to be moved through said opening, wherein said restraint substantially returns to its original position after deflection to restrict removal of a detergent tablet in said body portion through said opening.

2. A liquid permeable dispensing device according to claim 1, wherein said restraint comprises at least one flexible member which is substantially limited to deflection in only one direction so that a detergent tablet can be inserted through said opening by deflecting said flexible member.

3. A liquid permeable dispensing device according to claim 2, wherein said opening has a rim portion and said flexible member has a bar element extending below said rim portion wherein said bar element is restricted by said rim portion, thereby substantially limiting the deflection of said flexible member to one direction only.

4. A liquid permeable dispensing device according to claim 3, wherein said flexible member comprises at least one resiliently deformable member.

5. A liquid permeable dispensing device according to claim 3, wherein said restraint comprises at least one resiliently hingeable device for normally biasing the restraint to its original position.

6. A liquid permeable dispensing device according to claim 2, wherein said flexible member is releasably secured to said body.

7. A liquid permeable dispensing device according to claim 2, wherein said flexible member comprises at least one reiliently deformable member.

8. A liquid permeable dispensing device according to claim 2, wherein said restraint comprises at least one resilient hinge element which normally biases the restaint toward its original position.

9. A liquid permeable dispensing device according to claim 2, wherein said body comprises a substantially rigid framework having top, side wall and base portions.

10. A liquid permeable dispensing device according to claim 2, wherein said body comprises a fastening means to secure said device in a releasable manner to the interior of an automatic washing machine.

11. A liquid permeable dispensing device according to claim 2, wherein said body is formed of an injection molded synthetic plastics material.

12. A liquid permeable dispensing device according to claim 1, wherein said restraint comprises at least one flexible member which substantially covers said opening.

13. A liquid permeable dispensing device according to claim 1, wherein said restraint is releasably secured to said body.

14. A liquid permeable dispensing device according to claim 1, wherein said body comprises a substantially rigid framework having top, side wall and base portions.

15. A liquid permeable dispensing device according to claim 14, wherein said restraint comprises two resiliently deformable sheet members oppositely disposed on said body portion adjacent said opening, each of said sheet members including a first portion coplanar with its respective side wall and a second portion disposed at an acute angle to said side wall.

16. A liquid permeable dispensing device according to claim 15, wherein said opening is adjacent said top portion.

17. A liquid permeable dispensing device according to claim 1, wherein said body comprises a fastening means to secure said device in a releasable manner to the interior of an automatic washing machine.

18. A liquid permeable dispensing device according to claim 1, wherein said body is formed of an injection molded synthetic plastics material.

* * * * *